United States Patent [19]

Spruiell

[11] 4,269,566

[45] May 26, 1981

[54] CENTRIFUGAL PUMP FOR ABRASIVE LIQUIDS

[76] Inventor: Walter L. Spruiell, P.O. Box 547, Iowa Park, Tex. 76367

[21] Appl. No.: 942,117

[22] Filed: Sep. 13, 1978

[51] Int. Cl.[3] ..... F04D 29/08

[52] U.S. Cl. ..... 415/112; 415/170 B

[58] Field of Search ..... 415/110, 111, 112, 113, 415/114, 170 B, 168, 53

[56] References Cited

U.S. PATENT DOCUMENTS

| | | | |
|---|---|---|---|
| 1,314,875 | 9/1919 | La Bour | 415/53 |
| 1,789,528 | 1/1931 | Lewis | 415/53 |
| 1,947,017 | 2/1934 | McHugh | 415/110 |
| 2,250,714 | 7/1941 | LaBour | 415/53 |
| 2,603,160 | 7/1952 | La Bour | 415/53 |
| 2,711,332 | 6/1955 | Audemar | 415/113 |
| 3,230,890 | 1/1966 | Yokota et al. | 415/168 |
| 3,639,073 | 2/1972 | Beck, Jr. et al. | 415/112 |

FOREIGN PATENT DOCUMENTS

| | | | |
|---|---|---|---|
| 277623 | 1/1912 | Fed. Rep. of Germany | 415/168 |

*Primary Examiner*—Louis J. Casaregola

*Attorney, Agent, or Firm*—Stephen D. Carver; Wayland D. Keith

[57] ABSTRACT

In the pumping of abrasive liquids, particularly drilling mud, the packing and seals of the centrifugal pump are quickly cut out, making replacement and down time a problem. The present invention utilizes the abrasive liquid being pumped to function instead of packing and seals, furthermore, the suction chamber is between the abrasive liquid forming the seal, within the sealing housing, and the primary impeller chamber.

2 Claims, 6 Drawing Figures

CENTRIFUGAL PUMP FOR ABRASIVE LIQUIDS

SUMMARY OF THE INVENTION

This invention relates to pumps for pumping heavy abrasive liquids, such as mud used in the drilling of oil wells. The packings of such pumps are readily cut out by the abrasive particles in the mud. Pumps of this general character have been proposed hereofore, but for the most part, such pumps utilized a separate circulating of liquid that did not have the abrasive property.

The present pump utilizes an impeller which draws a portion of the liquid being pumped into a separate centrifugal chamber, which, when the pump is operating, creates a liquid seal with the abrasive laden liquid around the outer periphery of the chamber, while the pump is running, which prevents the suction of air into the primary centrifugal pump chamber, which is separate and apart from the centrifugal impeller chamber, which performs the sealing action. The suction chamber is located between the centrifugal impeller chamber, in which the liquid seal is created and the primary centrifugal impeller chamber. When the pump is not rotating or when it is rotating at very low speed, a disc-type elastomer seal closes the passage between the shaft and the housing, in which the impeller is located, and the atmospheric pressure.

The impeller which creates a liquid seal between the shaft and the primary centrifugal pump chamber has impeller blades thereon, which blades draw in liquid through an annular opening around the hub of the impeller and directs the liquid outwardly until the liquid seal chamber is filled to the circumferentially spaced holes which discharge the mud, or the like, back into the suction chamber and hence the primary pump chamber. Therefore, a band of mud or abrasive laden liquid surrounds the sealing impeller in the fluid sealing chamber. In this manner, no special liquid need be used for the liquid sealing impeller.

Initially, the centrifugal pump has to be primed, as does any centrifugal pump, but when once primed, the liquid being pumped is drawn through the suction inlet of the pump into the primary suction chamber having the primary centrifugal pump impeller mounted there, and rotatable with a shaft by a source of power (not shown). The primary pump impeller will be rotated in the direction indicated by the arrow in FIG. 2, to discharge the liquid upward into and out through the fluid reservoir, so as to maintain a static level in the reservoir, when the pump is not running, which static liquid enables the pump to be instantly primed. However, to initially start the pump, the desired amount of liquid is directed into the reservoir through a fill opening, whereupon, the pump is started and the primary impeller exerts a suction on the inlet suction pipe and fills the reservoir, whereupon, a stop cock is closed to maintain the desired liquid level in the reservoir, for future use in priming the pump. The pump chambers are supplied with drainage openings, through which the pump may be drained to prevent freezing of liquid in the pump chambers, when the pump is not in operation.

OBJECTS OF THE INVENTION

An object of this invention is to provide a self-sealing, packless centrifugal pump, which pump is so constructed as to handle heavy, abrasive liquids without cutting out the shaft, where the shaft passes into the centrifugal pump chamber.

Another object of the invention is to provide a suction pipe between the abrasive liquid seal impeller and the primary mud impeller housing so as to create a suction in the liquid seal impeller housing, when the pump is running.

Yet another object of the invention is to provide a packless centrifugal pump which utilizes the liquid being pumped as the sealing element.

A further object of the invention is to provide a centrifugal pump which utilizes a reservoir into which to pump the liquid, with the discharge pipe from the pump extending into the reservoir a sufficient distance to maintain a sufficient head of liquid therein to subsequently prime the pump.

Yet a further object of the invention is to provide a conduit which connects the bottom of the liquid reservoir with the primary housing of the pump, the conduit having a stop cock therein to provide a ready supply of priming liquid from the liquid being pumped, to enable the centrifugal pump to be quickly primed.

Still a further object of the invention is to provide a sealing impeller, the blades of which are substantially radial and are positioned on each side therof, which impeller is rotated with the pump shaft, to create a suction within the impeller sealing housing.

Still another object of the invention is to provide a sufficient number of holes in the walls of the suction housing to provide a cross-sectional area less than that between the hub and the impeller housing.

These and other objects and advantages of this invention, along with features of novelty appurtenant thereto, will appear or become apparent in the course of the following description.

DETAILED DESCRIPTION OF THE DRAWINGS

In the following drawings which form a part of this specification and which are to be construed in conjunction therewith, and in which like reference numerals have been employed throughout to indicate like parts and the various views:

DESCRIPTION OF THE PREFERRED EMBODIMENT OF THE INVENTION

Figure 2:
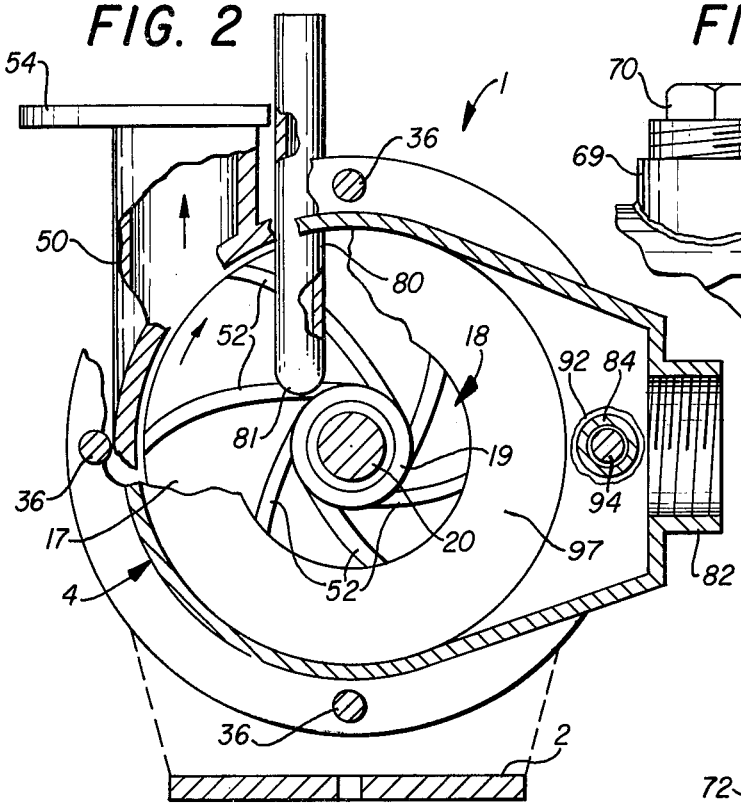
FIG. 2 is a sectional view taken on the line 2—2 of FIG. 1, looking in the direction indicated by the arrows, with parts being shown in section to bring out the details of construction.

With more detailed reference to the drawings, the numeral 1 designates generally a centrifugal pump having a base 2 and a pump housing 4. The pump housing 4 is mounted on one end of the base 2. A bearing housing 6 is mounted on the opposite end of the base 2, and is secured thereto by means of bolts 8 and 10, which bolts pass through upstanding lugs 12 and 14, respectively of the base 2, which bolts also pass through the pump housing 4, at one end thereof, and through the bearing housing 6 at the opposite end thereof, as will best be seen in FIG. 1.

The pump housing 4 has three chambers formed therein, including chamber 16 in which the primary centrifugal impeller is mounted, a sealing impeller chamber 29, and an intermediate suction chamber 13. The centrifugal impeller 18 is mounted within the chamber 16 by the screw threaded impeller 18 being screw threaded onto the screw threads 22 on hub 19 of shaft 20. The hub 19 is secured onto the shaft 20 by interfitting screw threads 21 of hub 19. A spacer 24 is sleeved over the pump shaft 20 so as to protect the pump shaft against abrasion. The spacer 24 also forms an abutment between the inner end of the hub 19 of the primary impeller 18 of the centrifugal pump 1, and the adjacent end of the hub 26 of the sealing impeller 28 within the impeller housing 29. The opposite end of the hub 26 abuts with a sleeve 30, which sleeve is interposed between the impeller 18 and a shoulder 32 on the shaft 20. The sleeve 24 bindingly engages the end of hub 26 of the sealing impeller and the sleeve 30 on which sleeve 30 an elastomer sealing disc is mounted. The primary centrifugal pump impeller 18, the sleeve 24, the sealing impeller 28 and the elastmer disc seal 34 rotate in unison with the shaft 20. Suction from rotation of impeller 18 draws mud or fluid into suction chamber 13 via inlet pipe 82. Chambers 13 and 16 communicate via passageway 96, at the center of intermediate circular partition 97.

The pump housing 4 is so constructed that the end plate 5 thereof may be removed by removing the nuts from the bolts 36, which will make possible the removal and replacement of the primary centrifugal pump impeller 18, without dismantling the entire pump assembly.

Figure 4:
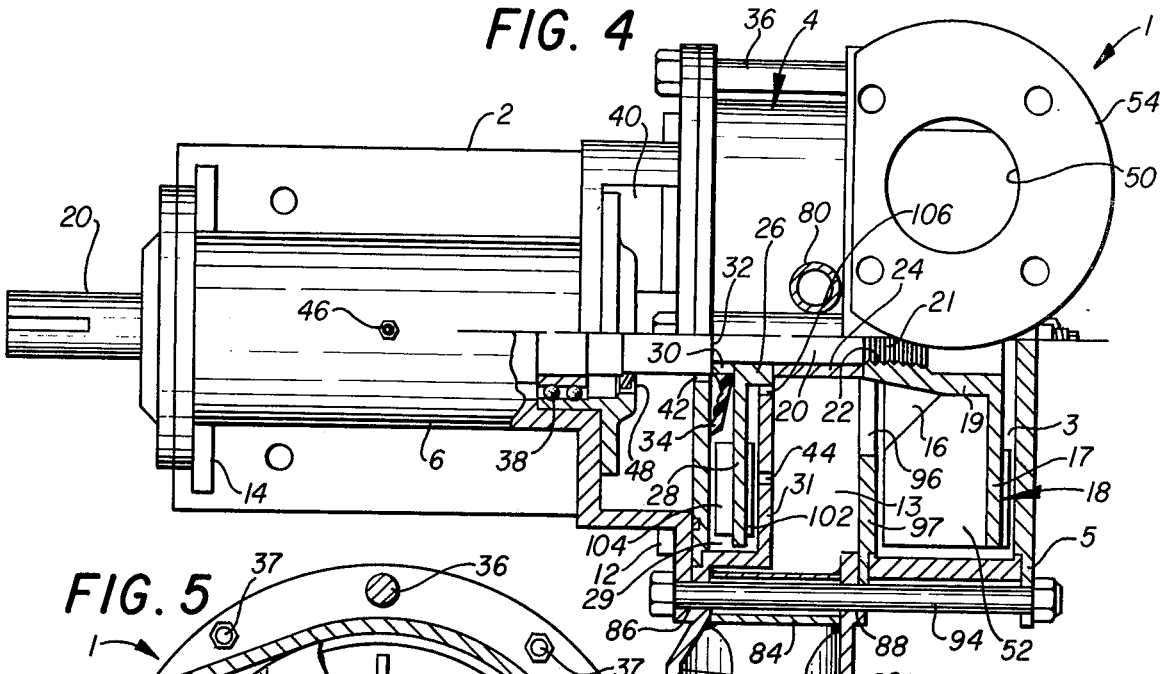
FIG. 4 is a top view of the pump, the reservoir stop cock and coupling not being shown, a quarter section of the pump and pump housing being shown in section to bring out the detail of construction.

The bearing housing 6 has anti-friction bearings 38 mounted therein, on which to journal shaft 20, as will best be seen in FIG. 4. The bearing housing 6 is separated from the sealing impeller housing 29 by space 40, which is open to atmosphere, so that the annular opening 42 will permit atmospheric pressure to enter the housing 29 so that the force built up by the centrifugal action of the mud around the outer periphery of the sealing impeller housing 29 will form a fluid tight seal between the outer periphery of the impeller housing 29 and the circumferentially spaced apart liquid discharge holes 44 in the partition 31 between the sealing impeller 28 and the primary impeller 18.

The spaced apart liquid discharge holes 44 are of a size that will cause the sealing impeller 28 to hold a static fluid pressure thereon while the impeller is rotating, but will prevent mud from passing from the pump housing 4 out through the annular space 42 between the shaft 20 and the outer housing plate 27 of the sealing impeller housing 29. A further hole 45, which is relatively small in cross sectional area, is formed in the outer periphery, in the bottom thereof, of the housing 29, which will exhaust a small amount of mud or the like to keep the impeller housing relatively free of mud, when the pump is stopped for a period of time. This hole 45 also forms a drainage vent to prevent the mud freezing in the impeller housing 29. The centrifugal action of the mud around the outer impeller housing 29 will create a suction to draw the mud through the annular opening 106 around the hub 26 of the sealing impeller 28, which will also exert a suction on the annular openings 42 in the wall of the housing 27 to prevent mud from leaking outward when the pump is running. The elastomer, ribbed disc 34 will prevent mud from leaking out when the impeller is not running.

The bearing housing 6 is filled with lubricant and has a lubricant fitting 46 therein, which bearing housing is spaced longitudinally, a spaced distance outward from the outer housing plate 27, with an open space therebetween so as to prevent any possibility of mud getting into the bearing housing. The bearing housing 6 has a lubricant seal 48 around the shaft 20, one near each end of the housing to retain lubricant therein and to prevent foreign matter from entering the bearing housing 6.

The pump 1 has a discharge pipe 50 leading tangentially from one side of the housing 4, so that the spiral impeller 18 will direct liquid, under pressure, outward through the discharge pipe 50, which pipe has a flange 54 mounted thereon, as by welding. The liquid from the centrifugal pump 1 will be discharged from pipe 50 into connecting pipe 56, which pipe has a flange 58 secured thereto, as by welding.

A reservoir 64 is mounted on the pipe 56 and interconnects with the housing 4 of the pump 1, so as the mud or other abrasive liquid is discharged from the pipe 56, it will be directed into the reservoir 64. The pipe 56 extends into the reservoir a sufficient distance to maintain a sufficient head of abrasive liquid, under pressure, to enable the pump to be primed by opening stop cock or valve 76 in pipe 74, so as to supply the liquid for the pump.

The flange 54 is bolted, in fluid tight relation, to the flange 58 by bolts 60. The pipe 50 extends through an opening 57 in the bottom of reservoir 64 and upward thereinto a spaced distance from the bottom, to prevent the liquid 66, which is being pumped therinto, from draining back through pipe 56 into the housing 4 of the pump 1.

The reservoir 64 has an outlet pipe 68, which pipe leads to a place of disposal or storage for the liquid being pumped. A sleeve 69 is welded to the top of reservoir 64 to surround the opening therein so as to be in liquid communication with the reservoir for the introduction of priming liquid into the reservoir through the sleeved opening 69, until a sufficient amount of liquid is within the reservoir to form a prime for the centrifugal pump.

A closure, such as plug 70, is screw threaded into the sleeved opening 69 so that the liquid discharged into the reservoir 64 will be forced outward through pipe 68, under pressure, to the place of storage or disposal.

The lower side of the reservoir 64 has an opening 72 formed therein, at the lower portion thereof, into which opening a pipe 74 is welded, so that the contents of the reservoir or a portion thereof, may be drained through pipe 80. With the stop cock or valve 76 open, the liquid will be directed through the clamp type fitting 78 into the pipe 80, thence downward into the chamber 3 in pump housing 4, until sufficient liquid is within the pump housing to form a prime, which will enable a suction to be created in the inlet pipe 82 to enable the pump to pump a full head of liquid, when the shaft 20 and impeller 18 are rotated at the desired speed.

As soon as the reservoir 64 has been filled to at least the top of the discharge pipe 56, the valve 76 is closed, so as to retain the liquid supply within the reservoir 64 for the priming of the pump 1, the next time the pump is used, in event the pump has to be stopped.

Figure 5:
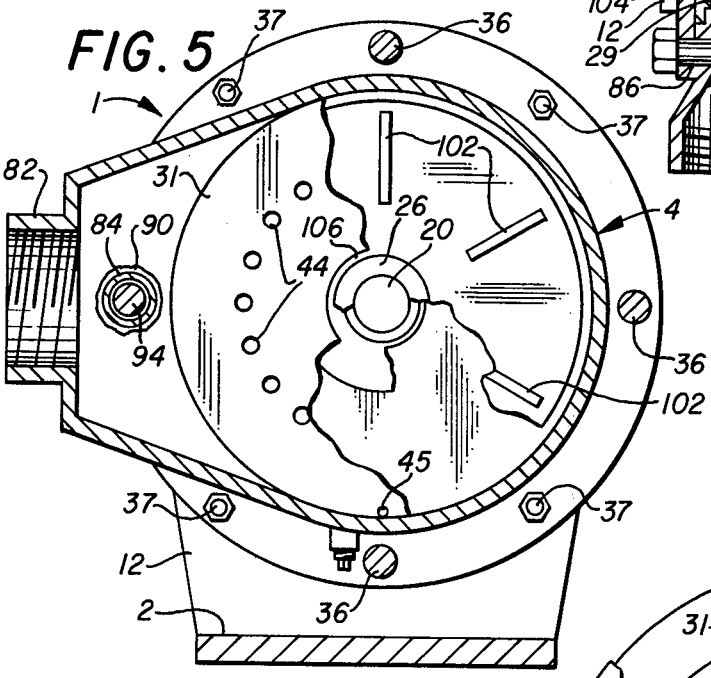
FIG. 5 is a sectional view taken on the line 5—5 of FIG. 1, looking in the direction indicated by the arrows.
Figure 6:
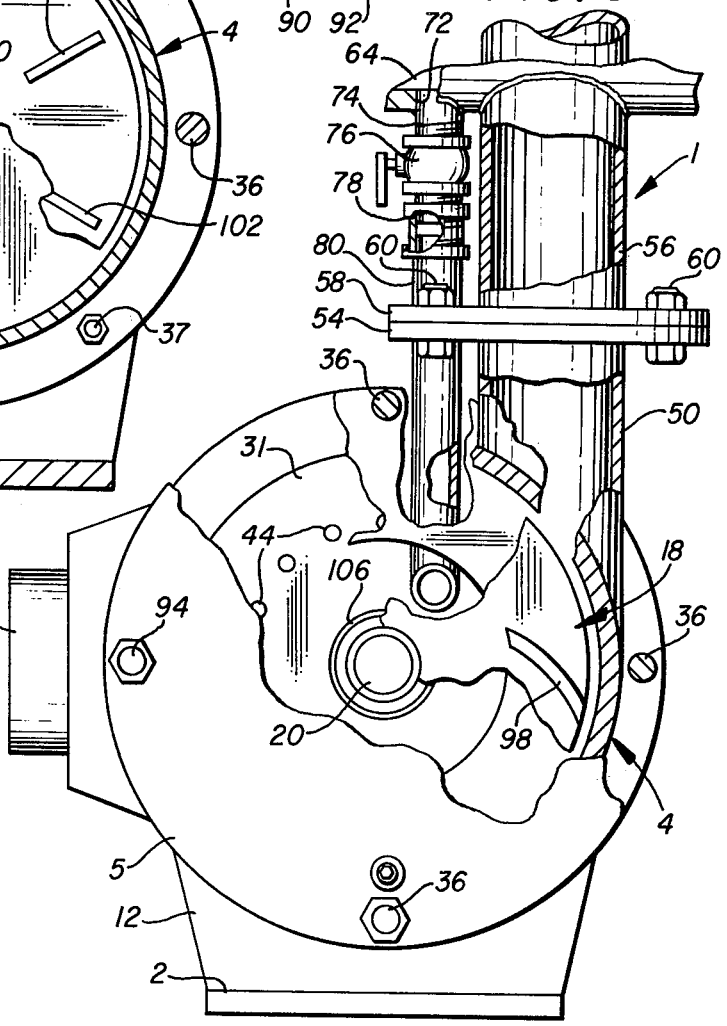
FIG. 6 is a side elevational view taken from the side opposite that shown in FIG. 2, showing a portion of the reservoir and of the discharge pipe in section, a fragmentary portion of the pump being broken away at different levels of the pump housing and of the primary impeller.

Since the pump 1 is used, for the most part, for pumping abrasive liquids, such as drilling mud, several impellers may be worn out before the housing 4 becomes worn to such extent that it has be be replaced. The sleeve 24 is provided around the shaft 20, in alignment with the suction pipe 82, which pipe is located between the impellers 18 and 28, so as to protect the shaft against abrasion. A sleeve, such as pipe 84, FIGS. 2, 4, and 5, is fitted intermediate the openings 86 and 88, FIG. 4, and is welded in place, as indicated at 90 and 92, so as to shield the bolt 94 from the abrasive action of the incoming abrasive liquid.

The pipe 80 has an inturned elbow-portion to direct the liquid from the reservoir 64 directly into the chamber 16 of the impeller housing 4, and, upon opening valve 76, the liquid will pass through the central opening 96 in housing 4, which directs the liquid being pumped axially into the housing 4. The impeller 18 includes a disc-like member 17, which member has spiral fins 98 on the side thereof opposite the primary spiral fins 52. The purpose of the fins 98 is to discharge liquid, such as drilling mud or other liquid bearing abrasive particles, to fill the portion of the chamber between the disc-like member 17 and the end 5 of the housing 4, which will greatly reduce the friction factor between the impeller 18 and the housing 4.

It is to be pointed out that the entire assembly is put together so that sections may be removed without taking the pump to a shop for repair. The bolts 36 extend longitudinally through the housing 4 of the pump, therefore, by removing the nuts from these bolts and the nuts from bolts 37, the housing 4 may be removed. Furthermore, by removing nuts from the bolts 8, and with the primary impeller 18 removed, the housing 29, which houses the sealing impeller 28, may be removed. This enables the removal of the sealing impeller 28 and the resilient member 34 for the repair and/or replacement of these parts, that may have become worn, without removing the nuts from the bolts 100.

However, upon removing the compression fitting 78 downward on pipe 80, the housings 4 and 29 may be moved longitudinally outward, when the impeller 18 has been removed. When this has been done, it enables the sleeve 24 and the housing 29 to be moved outwardly on shaft 20, if need be. This exposes the elastomer sealing disc 24, which fits on shaft 20. In so doing, the entire assembly within housings 4 and 29, respectively, may be repaired and/or replaced. The sealing impeller 28 has vanes 102 thereon, which vanes draw the liquid being pumped inwardly through an annular opening 106, which surrounds the hub of the impeller opening, which opening is of such size as to draw liquid into the housing 29 by the centrifugal action of the sealing impeller 28. The annular opening 42 permits the liquid within the housing 29 to be equalized at atmospheric pressure and discharged out through circumferentially spaced openings 44 which lead through inlet opening 96 into housing 4 to discharge the liquid outward through discharge pipe 50, to pipe 56 and into reservoir 64 to be discharged through pipe 68.

However, a band of liquid will surround the inner diameter of the housing 29 to form an obstruction against the entrance of air into the housing 4, and will prevent the discharge of liquid out through annular opening 42, so long as the impeller is rotating at a normal speed.

When the rotation of the impellers 18 and 28 drops below a predetermined speed, the elastomer sealing disc 34 will move inwardly against the wall 27 to form a seal, when the impellers are rotating at slow speed or have stopped rotating, thereby preventing the liquid from being discharged from housings 4 and 29.

In the pumping of drilling mud from a mud pit, the pipe 82 is connected to the pit by a hose or pipe which has a foot valve on the lower end thereof to prevent retrogression of the mud, once it has been picked up by the pump.

Figure 1:
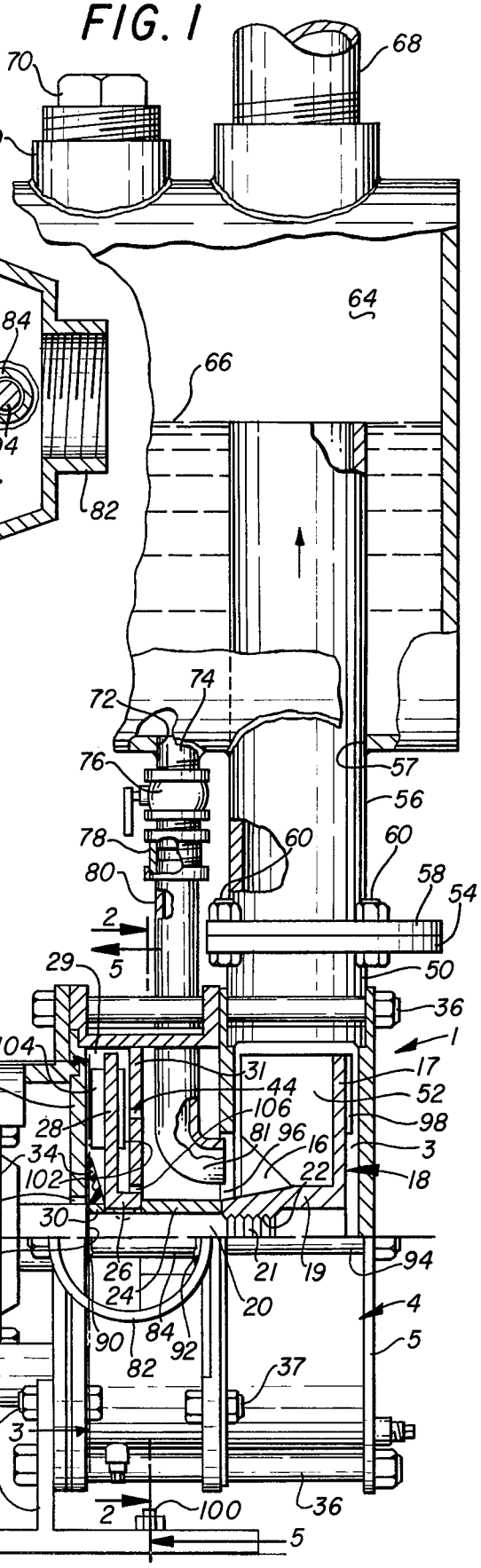
FIG. 1 is a side elevational view of the centrifugal pump, showing an inlet opening therefor, showing a portion of the pump is section, with parts of the discharge pipe, reservoir and priming pipe being broken away and shown in section to bring out the details of construction, a liquid being retained after the pump is stopped.
Figure 3:
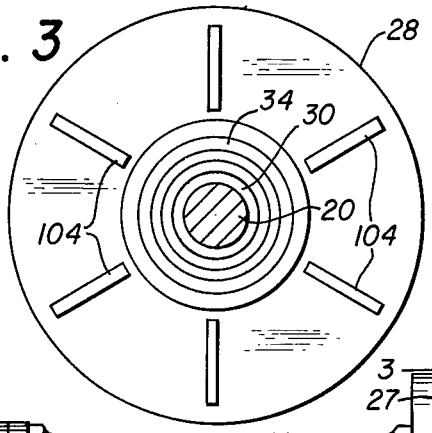
FIG. 3 is a sectional view taken on the line 3—3 of FIG. 1, looking in the direction indicated by the arrows, showing the liquid seal impeller, and the elastomer disc apart from the rest of the pump.

The reservoir 64 is positioned above the pump 4 and the drilling mud is discharged into the reservoir to a predetermined depth, as determined by upstanding pipe 56. The pipe 56 is usually extended into the reservoir about one-half the depth thereof, and with the valve 76 closed, drilling mud will be trapped in the reservoir to enable the pump to be initially primed, when the pumping action is first started. The pipe 80 extends between the reservoir 64 and the interior of the pump 4, as best seen in FIG. 1. The pipe 80 has the lower end thereof in-turned, which directs the drilling mud or the like into the axis of the pump 4, when the pump is operating. The valve 76, in pipe 80, is positioned intermediate the reservoir 64 and the pump 4. When the valve 76 is closed, the drilling mud will be entrapped in the reservoir 64 above the upper end of the pipe 56.

When the pumping action of the pump has reached nearly full capacity, the center portion 16, of the impeller 52, will have a large air bubble created in the central impeller opening 16, which will impede the entrance of mud into the pump. When this situation occurs, the valve 76 is opened, which will permit mud to be withdrawn form the reservoir 64 and directed into pipe 74 into the impeller chamber of the pump 4. This will not lessen the pressure which will be generated by the pump 4 into the reservoir 64 and out through pipe 68. Mud coming through suction pipe 82 is slightly aerated, therefore air will collect in the throat 16 of the impeller, which will block the flow of mud into the pump. Whereupon, valve 76 will be opened and a jet stream of mud will flow from reservoir 64 into the throat 16 of the impeller to break up the air bubble. The air will pass out through discharge pipe 56 into the reservoir 64 and out through discharge pipe 68.

It is to be pointed out that the shaft 20 operates in a suction which approaches a vacuum, not with the pump pressure against it, as is the case with most conventional centrifugal pumps.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A liquid-sealed, tangentially-fed centrifugal pump comprising:

a rigid, generally cylindrical pump housing adapted to be coupled to a supporting structure;

an internally-disposed generally coaxially aligned drive shaft adapted to be rotated by an external motor;

primary impeller means rotatably disposed within an internal primary impeller chamber within said housing and coupled to said drive shaft for rotation thereby for generating vacuum whereby to operate said pump;

sealing impeller means having a diameter substantially equal to the diameter of said primary impeller means and disposed within a separate spaced apart sealing chamber within said housing and driven by said shaft, said sealing impeller means spaced apart from said primary impeller means;

intermediate suction chamber means disposed within said housing between said sealing chamber and said primary impeller chamber;

divider means disposed within said housing between said suction chamber means and said primary impeller means, said divider means including first passageway means defined between it and said shaft to facilitate fluid flow communication between said suction and said primary impeller chambers;

partition disk means rigidly secured within said pump housing between said intermediate chamber and said sealing chamber;

inlet pathway means coupled to said pump housing substantially tangentially with respect to said primary impeller for delivering liquid to be pumped interiorly of said suction chamber at a point substantially between said primary impeller means and said sealing impeller means;

second passageway means defined between said shaft and said disk for facilitating passage of liquid between said intermediate chamber and said sealing chamber;

a plurality of vanes disposed at radially spaced-apart locations on the periphery of said sealing impeller for drawing liquid upwardly into the peripheral confines of said sealing chamber to create a seal; and, output passageway means in fluid flow communication with said primary impeller chamber for outputting materials from said pump.

2. The combination as defined in claim 1 including a plurality of radially spaced apart discharge apertures defined in said partition disk for transmitting pressurized liquids from said sealing chamber into said suction chamber whereby to neutralize pressure differential.

* * * * *